US005224597A

United States Patent [19]

Hauchard

[11] Patent Number: 5,224,597

[45] Date of Patent: Jul. 6, 1993

[54] STICK OF SEPARABLE MARKER DEVICES, FOR ELECTRICAL EQUIPMENT AND THE LIKE, AND ASSOCIATED STORAGE DEVICE

[75] Inventor: Patrick Hauchard, Maromme, France

[73] Assignee: Legrand, Limoges, France

[21] Appl. No.: 757,204

[22] Filed: Sep. 10, 1991

[30] Foreign Application Priority Data

Oct. 2, 1990 [FR] France ..... 90 12105

[51] Int. Cl.[5] ..... B65D 85/02

[52] U.S. Cl. ..... 206/459.5; 40/316; 206/345; 206/820

[58] Field of Search ..... 40/316, 665; 206/328, 206/330, 331, 338, 343-348, 459, 820, 459.5

[56] References Cited

U.S. PATENT DOCUMENTS

| | | | |
|---|---|---|---|
| 2,811,702 | 10/1957 | Narozny | 206/330 |
| 3,955,674 | 5/1976 | Maier et al. | 206/347 |
| 4,032,010 | 6/1977 | Evans | 40/316 |
| 4,206,909 | 6/1980 | Wintle | 40/316 |
| 4,234,090 | 11/1980 | Barbieri et al. | 206/820 |
| 4,363,401 | 12/1982 | Savagian | 206/820 |
| 4,442,939 | 4/1984 | Downing | 206/820 |
| 4,488,642 | 12/1984 | Changani et al. | 40/316 |
| 4,632,247 | 12/1986 | Moody et al. | 206/820 |
| 4,662,094 | 5/1987 | Jaffe | 40/316 |
| 4,865,895 | 9/1989 | Vlamings et al. | 206/820 |

FOREIGN PATENT DOCUMENTS

| | | | |
|---|---|---|---|
| 0138258 | 4/1985 | European Pat. Off. . | |
| 2444892 | 4/1976 | Fed. Rep. of Germany | 206/328 |
| 1254544 | 6/1961 | France | 40/316 |
| 1391913 | 2/1965 | France | 40/316 |
| 0750670 | 6/1956 | United Kingdom | 40/316 |
| 1132955 | 11/1968 | United Kingdom . | |
| 1219283 | 1/1971 | United Kingdom | 40/316 |

*Primary Examiner*—Jimmy G. Foster
*Attorney, Agent, or Firm*—Young & Thompson

[57] ABSTRACT

A stick of separable marker devices comprise support and a plurality of marker devices in a row detachably carried by the support. The support is made from a synthetic material. The marker devices that it carries are in one piece with it.

24 Claims, 2 Drawing Sheets

STICK OF SEPARABLE MARKER DEVICES, FOR ELECTRICAL EQUIPMENT AND THE LIKE, AND ASSOCIATED STORAGE DEVICE

BACKGROUND OF THE INVENTION

1. Field of the Invention

The present invention is generally concerned with marker devices used to identify or to mark electrical equipment such as cables, terminal blocks, etc.

It is more particularly directed to marker devices sometimes called "protected" marker devices which are designed to be fitted into a marker device holder attached for this purpose to the equipment concerned.

They carry a digit, a letter or any other conventional symbol, for example, and are generally used in combinations made up according to specific requirements.

2. Description of the Prior Art

At present such marker devices are usually supplied as a stick of separable marker devices comprising a support on which a plurality of marker devices of the same kind are detachably mounted in a row.

At present, the marker devices are usually adhesively bonded to the support.

This has various drawbacks.

First and foremost, as the support and the marker devices are manufactured separately, a multiplicity of separate and successive operations is required to assemble each stick of separable marker devices.

It is necessary to manufacture the support and also to produce the marker devices, which might be extruded, for example, in which case the extruded product must then be cut to the required length. Finally, the marker devices must be adhesively bonded to the support.

This results in a high unit cost.

Adhesive bonding provides inadequate control over the fixing of the marker devices to the support and experience shows that it is not rare for some at least of the marker devices to be detached prematurely from the support during successive handling operations, which in practice means that they are lost.

Finally, as the marker devices are necessarily applied as closely as possible to the support, in order to be properly secured to it, it is often difficult to pick them off, even when a picking device is used, as is the usual practice.

A general object of the present invention is an arrangement whereby these drawbacks can be eliminated and additional advantages obtained.

SUMMARY OF THE INVENTION

In a first aspect, the present invention consists in a stick of separable marker devices comprising a support and a plurality of marker devices in a row detachably carried by said support which is made from a synthetic material, the marker devices that it carries being in one piece with it; in another aspect the invention consists in a storage device adapted to store a plurality of such sticks of separable marker devices.

To summarize, according to the invention the support and the marker devices carried by it are advantageously manufactured at the same time by virtue of a single molding operation, reducing the overall cost.

This additionally provides good control over the fixing of the marker devices to the support and under normal circumstances none of the marker devices can be prematurely separated from the support, having to be deliberately detached therefrom.

In a preferred embodiment of the invention, each of the marker devices lies between two parallel flanges projecting from the support. Each flange is manufactured in one piece with the support and each marker device is itself manufactured in one piece with each flange, to which it is linked by an area of reduced strength.

The marker devices are thereby suspended, as it were, from the flanges to either side of them and the flanges advantageously protect them from unwanted impact. Because of the flanges, the marker devices can be advantageously raised relative to the support, to make them easier to pick off.

In a preferred embodiment of the invention, the support is in the form of a simple plate which has a non-planar overall configuration (a dihedron shape, for example), and the marker devices that it carries are on its convex side.

When stored in a storage device, the sticks of separable marker devices are advantageously offered up obliquely to the user, which makes it easier for the user to pick them out or to pick off the individual marker devices. This advantage is secured without complicating the construction of the storage device.

The storage device may then be formed with straight grooves for storing the sticks of separable marker devices, which facilitates its manufacture.

Finally, in accordance with the invention the sides of each groove in the storage device advantageously have spaced projecting bosses which alternate from one side to the other.

Being a slight force-fit in the groove, the support of a stick of separable marker devices in accordance with the invention assumes a slightly undulating configuration which has the advantage of securing it satisfactorily in a very simple manner.

The objects, features and advantages of the invention will emerge from the following description given by way of example with reference to the appended diagrammatic drawings.

DETAILED DESCRIPTION OF THE INVENTION

The figures show, by way of example, the application of the invention to marker devices 10 of tubular form with a generally oval transverse cross-section.

The general configuration of the marker devices 10 is well known in itself and as it does not form any part of the present invention will not be further described here.

Figures 1, 2, 3, 4, 5, 6, 7, 8, 9:
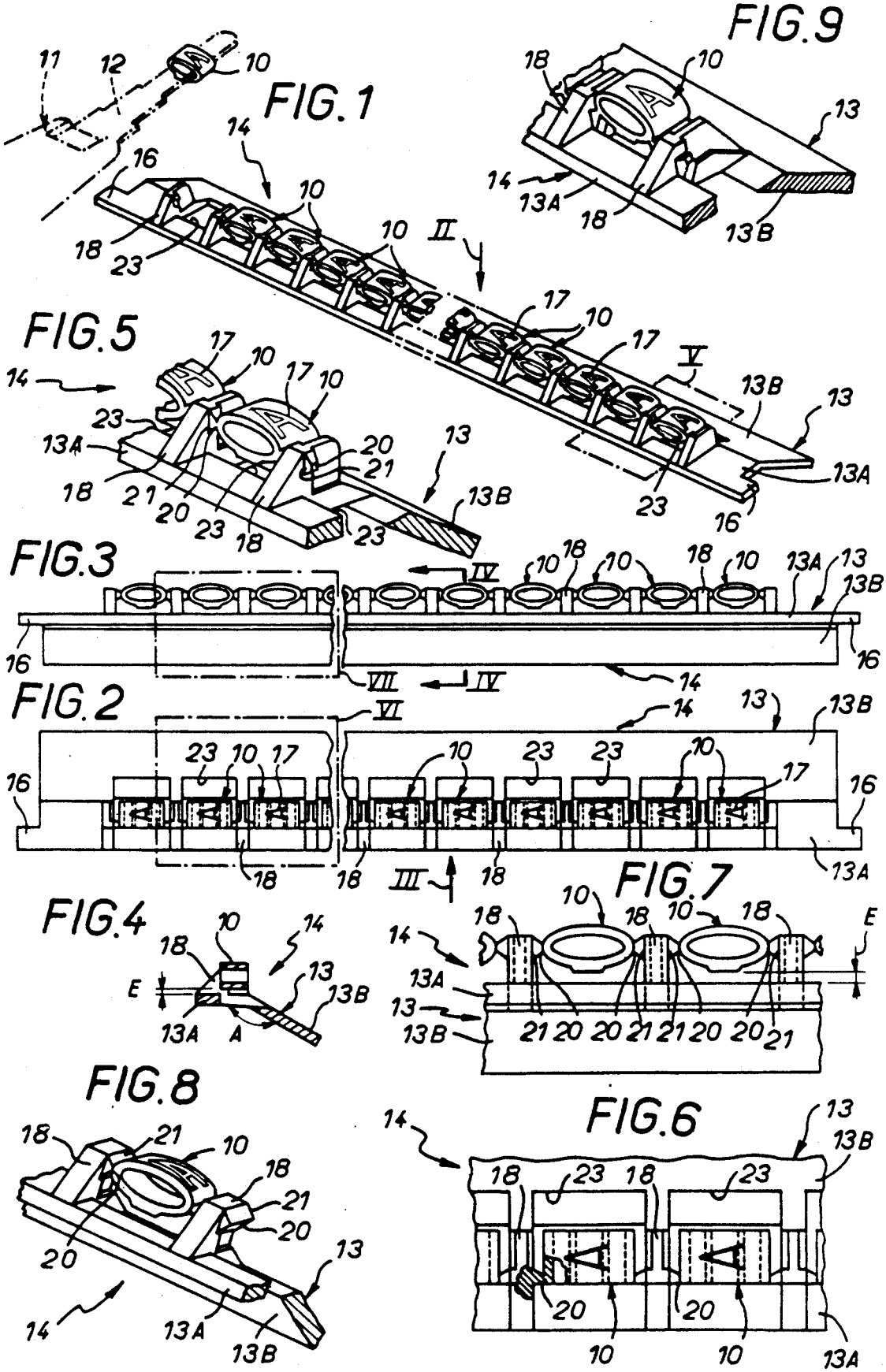
FIG. 1 shows a stick of separable marker devices in accordance with the invention with one of the marker devices detached therefrom.
FIG. 2 is a partial plan view of the stick of separable marker devices seen in the direction of the arrow II in FIG. 1 and to a larger scale.
FIG. 3 is a partial view in elevation of the stick of separable marker devices as seen in the direction of the arrow III in FIG. 2 and to the same scale as FIG. 2.
FIG. 4 is a view of the stick of separable marker devices in transverse cross-section on the line IV—IV in FIG. 3 and to the same scale.
FIG. 5 is a partially cut away view to a larger scale of the part of FIG. 1 identified by the box V.
FIG. 6 is a partially cut away view to a larger scale of the part of FIG. 2 identified by the box VI.
FIG. 7 shows the part of FIG. 3 identified by a box VII in FIG. 3 to the same scale as FIG. 6.
FIGS. 8 and 9 are partial perspective views analogous to those of FIG. 5 and each relating to a respective alternative embodiment.

Suffice to say that, as schematically represented in chain-dotted outline in FIG. 1, they are usually picked off by means of a picking device 11 which has a blade 12 onto which they are successively fitted in required sequence.

In a manner that is known in itself, the sticks 14 of separable marker devices each comprise a plurality of marker devices 10 of the same kind arranged in a row on a support 13, from which they can be detached relatively easily.

According to the invention, the support 13 is made from a synthetic material and the marker devices 10 that it carries are in one piece with it, the combination being manufactured in a single molding operation.

The support 13 is in the form of a simple thin plate with a generally rectangular contour. It has a non-planar overall configuration forming a dihedron shape.

It therefore has a first part 13A which carries the marker devices on the convex side and a second part 13B, wider than the part 13A and obliquely disposed relative to it.

The angle A of the dihedron is in the order of 150°, for example.

This numerical value is given here by way of example only, of course, and is in no way limiting on the invention.

A lug 16 to facilitate handling projects laterally at each transverse end of the part 13A of the support 13.

The marker devices 10 all carry the same symbol 17 (a letter of the alphabet in the example shown) and are all oriented the same way.

They are all transversely disposed relative to the support 13.

In other words, their generatrices are perpendicular to the lengthwise direction of the support 13.

According to the invention, each of the marker devices 10 extends between two parallel flanges 18 projecting from the support 13, to be more precise from the part 13A thereof. Each flange is in one piece with the support 13 and each marker device 10 is in one piece with two flanges through portions 20 of reduced strength.

Each portion 20 of reduced strength is formed by the end of a boss 21 in one piece with the flange 18 and having a transverse cross-section which reduces in the direction from the flange 18 to the marker device 10.

This transverse cross-section may be trapezium-shaped, for example, and the portion 20 of reduced strength may extend over only part of the length of a marker device 10 (see FIGS. 1 through 7).

As an alternative to this (FIG. 8), the transverse cross-section of a boss 21 may be triangular with the result that at its end, where it joins onto the marker device 10 concerned, the boss 21 is reduced to a narrow edge.

In this case, as shown in FIG. 8, the portion 20 of reduced strength extends over the full length of the marker device 10.

In the respective embodiments show in FIGS. 1 through 7 and FIG. 8 the portions 20 of reduced strength lie in the median plane of the marker devices 10, at the ends of the larger dimension of their transverse cross-section. This is not the case in the embodiment shown in FIG. 9.

In this embodiment the portions 20 of reduced strength lie below the median plane of the marker devices 10.

In this way the flash that inevitably remains on the marker devices 10 when the portions 20 of reduced strength are broken are advantageously hidden from view by the marker devices 10 themselves.

In either case, being suspended from the flanges 18, the marker devices 10 are advantageously separated from the support 13 by a distance E which facilitates picking them off.

There is an aperture 23 in the support 13 in line with each marker device 10 by means of which the marker devices 10 can be braced while a symbol 17 is printed on or otherwise applied to them.

To detach a marker device 10 from the support 11 all that is required is to insert into it the blade 12 of a picking tool 11 and to tilt or turn the latter until the portions 20 of reduced strength attaching it to two of the flanges 18 break.

Figure 10:
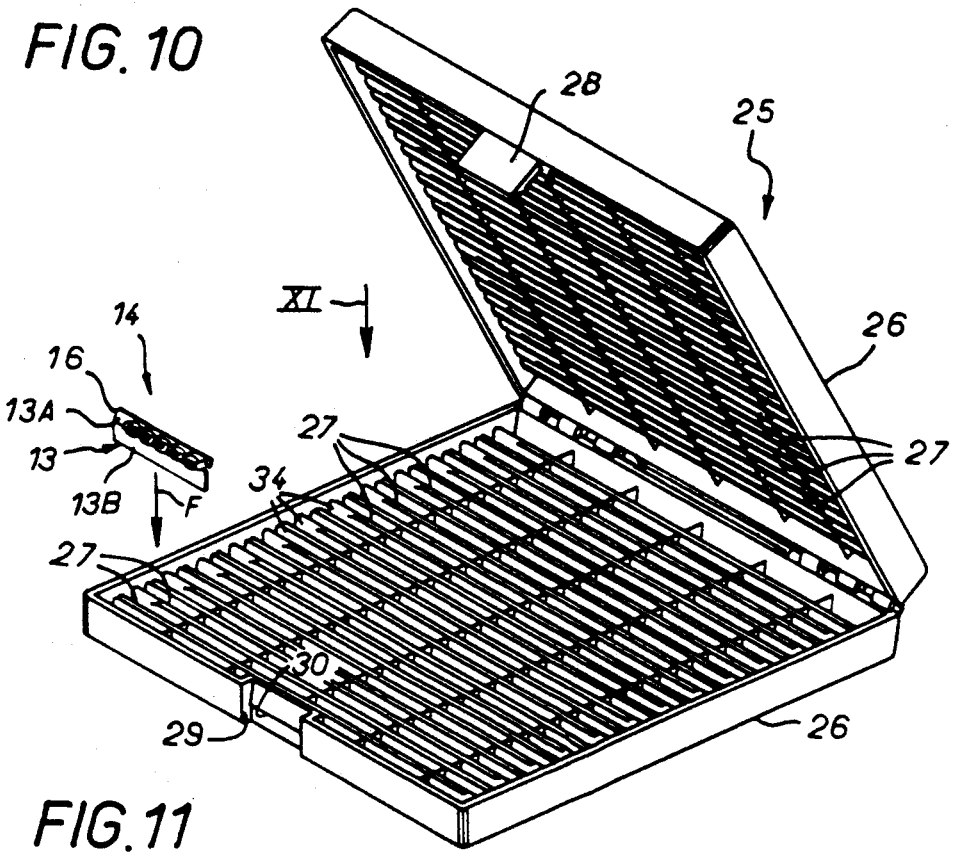
FIG. 10 is a perspective view of a storage device in accordance with the invention, shown open and in association with a stick of separable marker devices to be fitted into one of the grooves that it comprises.

As schematically represented by the arrow F in FIG. 10, the sticks 14 of separable marker devices are preferably stored in a parallel arrangement in a storage device 25.

In a manner that is known in itself, the storage device 25 comprises at least one panel 26 provided with grooves 27 each adapted to receive one stick 14 of marker devices.

In the embodiment shown the storage device comprises two panels 26 hinged together like the two halves of a briefcase in an arrangement well known to the man skilled in the art and which therefore does not need to be described in detail here. Each panel 26 is provided with an array of parallel grooves 27.

Apart from the clip means adapted to hold them in the closed position, the two panels 26 are in practice identical.

In the embodiment shown, the clip means comprise an elastically deformable tang 28 on one panel 26 forming a hook and in corresponding relationship on the other panel 26, within a recess 29 on the corresponding edge of the latter, a detent 30 over which the elastically deformable tang 28 can be clipped.

Figure 12:
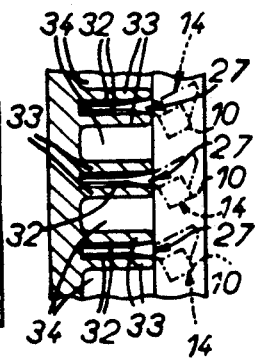
FIG. 12 is a partial view of the storage device in transverse cross-section on the line XII—XII in FIG. 11 and to a larger scale.
Figure 13:
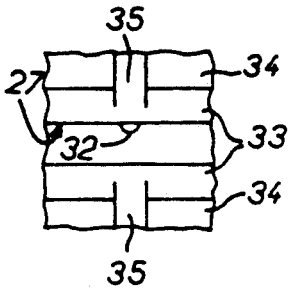
FIGS. 13, 14 and 15 respectively show the parts of FIG. 11 identified by the boxes XIII, XIV and XV in FIG. 11, to a larger scale.
Figure 14:
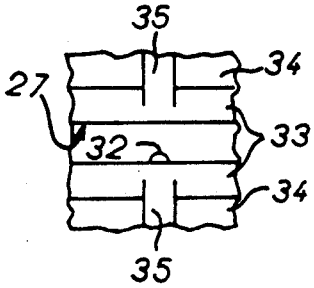
Figure 15:
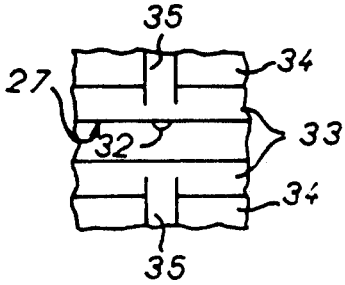

According to the invention, and as is seen more clearly in FIGS. 13 through 15, the sides of each groove 27 carry spaced projecting bosses 32 alternating from one side to the other. As can be seen in FIG. 12, they extend over virtually all of the height of a groove 27, starting from its bottom, diverging from each other at their ends.

The grooves 27 are in practice each formed between two partitions 33 and they alternate with grooves 34 accommodating transverse crossmembers 35 spanning at intervals the gap between a partition 33 of one groove 27 and the corresponding partition 33 of the immediately adjacent groove 27.

The crossmembers 35 may be in line with the bosses 32, for example, as shown here.

The bosses are thereby advantageously braced and are therefore adapted to impose upon the part 13B of the support 13 of a stick 14 of marker devices, when the latter is inserted into a groove 37, a loosely undulating configuration whereby the stick 14 of marker devices is adequately secured in the groove 27.

Figure 11:
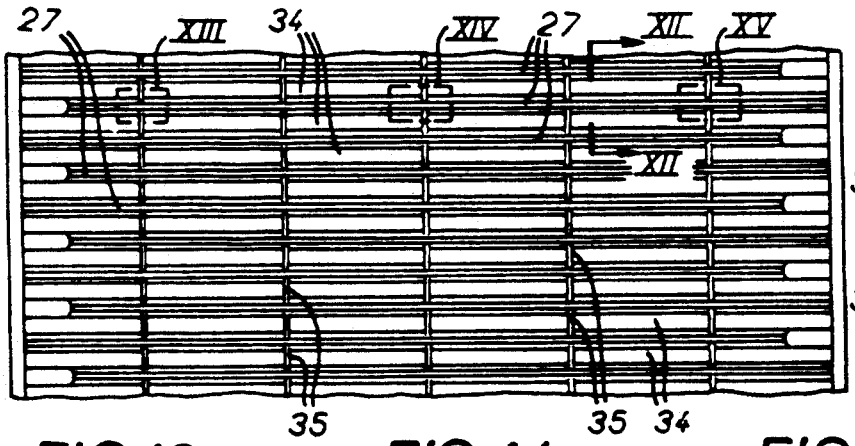
FIG. 11 is a partial plan view of the storage device as seen in the direction of the arrow XI in FIG. 10 and to a larger scale.

As schematically represented in chain-dotted outline in FIG. 11, the part 13A carrying the marker devices 10 of a stick 14 of marker devices fitted in this way into a groove 27 of the storage device 25 is advantageously obliquely disposed, which facilitates access to the stick 14 of marker devices or to the individual marker devices 10.

The grooves 27 of the storage device 25 can then with advantage be straight.

In other words, the partitions 33 which delimit them can advantageously be perpendicular to the base from which they are upstanding.

Of course, the present invention is not limited to the embodiments described and shown but encompasses any variant execution and/or combination of their various component parts.

For example, to achieve the required oblique disposition, the plate forming the support of the stick of separable marker devices in accordance with the invention could itself be straight overall, being attached in an oblique configuration to a strip member, possibly divided into separate sections, by means of which it is adapted to be inserted into a groove of the associated storage device.

Instead of simple lugs, the sticks of separable marker devices in accordance with the invention may be provided with grip strips, which may be notched.

There is claimed:

1. Stick of separable marker devices comprising a support having a longitudinal axis and a plurality of marker devices arranged in a longitudinal row detachably carried by said support, said support being made from a synthetic material, the marker devices being in one piece construction with said support, each marker device extending between two upstanding parallel flanges outwardly projecting from the support and in one piece therewith, said flanges being disposed substantially perpendicular to the longitudinal axis of the support, each marker device being in one piece with the respective flanges through portions of reduced strength.

2. Stick of separable marker devices according to claim 1 wherein each said portion of reduced strength is formed by the end of a boss in one piece with the adjoining flange and has a transverse cross-section which tapers in the direction from said flange to the corresponding marker device.

3. Stick of separable marker devices according to claim 2 wherein the end of said boss joined to a marker device is defined by a narrow edge.

4. Stick of separable marker devices according to claim 2 wherein said portion of reduced strength extends over the entire length of a marker device.

5. Stick of separable marker devices according to claim 2 wherein said portion of reduced strength extends over only part of the length of a marker device.

6. Stick of separable marker devices according to claim 1 wherein said portion of reduced strength lies below the median plane of a marker device.

7. Stick of separable marker devices according to claim 1 wherein said support comprises a simple plate.

8. Stick of separable marker devices according to claim 7 wherein said support has an overall dihedral configuration, and the marker devices are on a convex side of said dihedral configuration.

9. Stick of separable marker devices according to claim 7 wherein a lug projects laterally from each transverse end of said support in a part of said support which carries said marker devices.

10. Stick of separable marker devices according to claim 1 wherein said support comprises an aperture in line with each marker device.

11. A stick of integrated separable marker devices comprising a support of synthetic material having a longitudinal axis, a longitudinal row of marker devices spaced from each other and also of synthetic material, each of the marker devices having a transverse opening for selective insertion of marker picking means, said transverse openings extending substantially orthogonally to the longitudinal axis and being accessible laterally of the support, said marker devices being formed in one-piece construction with said support, said stick including means detachable connecting said marker devices to said support, such that said marker devices are disposed substantially outwardly of the support.

12. A stick according to claim 11, wherein said transverse openings are through openings and the marker devices comprise sleeves.

13. A stick according to claim 11, wherein said support extends in a longitudinal direction and said marker devices are arranged in a row parallel to said support.

14. A stick according to claim 11, wherein said means detachable connecting said marker devices comprise a plurality of aligned spaced flanges, respective pairs of adjacent aligned spaced flanges at least partially accommodating corresponding ones of said marker devices.

15. A stick according to claim 14, wherein zones of reduced strength are defined between said flanges and adjoining portions of adjacent ones of the marker devices.

16. A stick according to claim 14, wherein said flanges lie in planes substantially perpendicular to the longitudinal axis.

17. A stick according to claim 15, wherein each said zone of reduced strength is formed by the end of a boss in one piece with the adjoining flange and has a transverse cross section which tapers in the direction from said flange to the corresponding marker device.

18. A stick of integrated separable marker devices comprising a support of synthetic material having a longitudinal axis, and a plurality of marker devices also of synthetic material extending in a longitudinal row, said marker devices being formed in one-piece construction with said support, a plurality of aligned spaced flanges projecting outwardly from the support and extending perpendicular to the longitudinal axis, respective adjacent pairs of said flanges at least partially accommodating the plurality of said marker devices, said marker devices being selectively individually detachably connected to respective pairs of flanges.

19. A stick according to claim 18, wherein zones of reduced strength are defined between said flanges and adjoining portions of adjacent ones of the marker devices.

20. A stick according to claim 18, wherein each of said marker devices has means for cooperating with marker picking means, said means for cooperating with said marker picking means being accessible in directions orthogonal to the longitudinal axis.

21. A stick according to claim 20, wherein zones of reduced strength are defined between said flanges and adjoining portions of adjacent ones of the marker devices.

22. A stick according to claim 21, wherein each said zone of reduced strength is formed by the end of a boss in one piece with the adjoining flange and has a transverse cross section which tapers in the direction from said flange to the corresponding marker device.

23. A stick according to claim 18, wherein said means for cooperating with marker picking means comprise openings in said marker devices.

24. A stick according to claim 23, wherein said openings are through openings, and the marker devices comprise sleeves.

* * * * *